United States Patent [19]

Trojan et al.

[11] 3,970,470

[45] July 20, 1976

[54] CENTRIFUGE

[75] Inventors: Günter Trojan, Wattenscheid; Richard Böhm, Herne, both of Germany

[73] Assignee: Hein, Lehmann A.G., Dusseldorf, Germany

[22] Filed: Oct. 18, 1974

[21] Appl. No.: 516,001

[52] U.S. Cl. ..... 127/19; 127/56; 233/3; 233/14 A; 233/27

[51] Int. Cl.[2] ..... B04B 3/00; C13F 1/10

[58] Field of Search ..... 127/19, 56, 16; 233/3, 233/14 A, 27

[56] References Cited

UNITED STATES PATENTS

| | | | |
|---|---|---|---|
| 2,973,288 | 2/1961 | Riedel | 127/19 |
| 3,238,063 | 3/1966 | Steele | 127/19 |
| 3,535,158 | 10/1970 | McBride | 127/19 X |
| 3,837,913 | 9/1974 | Hillebrand | 127/19 |

*Primary Examiner*—Morris O. Wolk
*Assistant Examiner*—Sidney Marantz
*Attorney, Agent, or Firm*—V. Alexander Scher

[57] ABSTRACT

A centrifuge, specifically a sugar centrifuge for the continuous centrifuging of highly viscous fillmasses, has a separating sieve conically widening upwardly to the outlet and an accelerating pot having no holes, which reduces downwardly and is connected to the smallest diameter of the sieve. The fillmass is supplied to one pot from a so-called harrow slide through a delivery pipe. The fillmass within the accelerating pot is diverted once or several times by suitable means in such manner that it is delivered screen-like to the wall of the pot and is guided from one diverting point to another and within its screen-like formation is penetrated by regulatable amounts of water and/or steam. The total amount of water and/or steam supplied to the fillmass as well as their temperature suffice to decrease the viscosity of the fillmass to the desired amount. The inner space of the centrifugal drum is continuously controlled by a supervising device cooperating with the centrifuge relative to the height of the fillmass surface formed in the acceleration pot or in the delivery pipe during disturbances of the centrifugal drive.

16 Claims, 14 Drawing Figures

Figure 1:
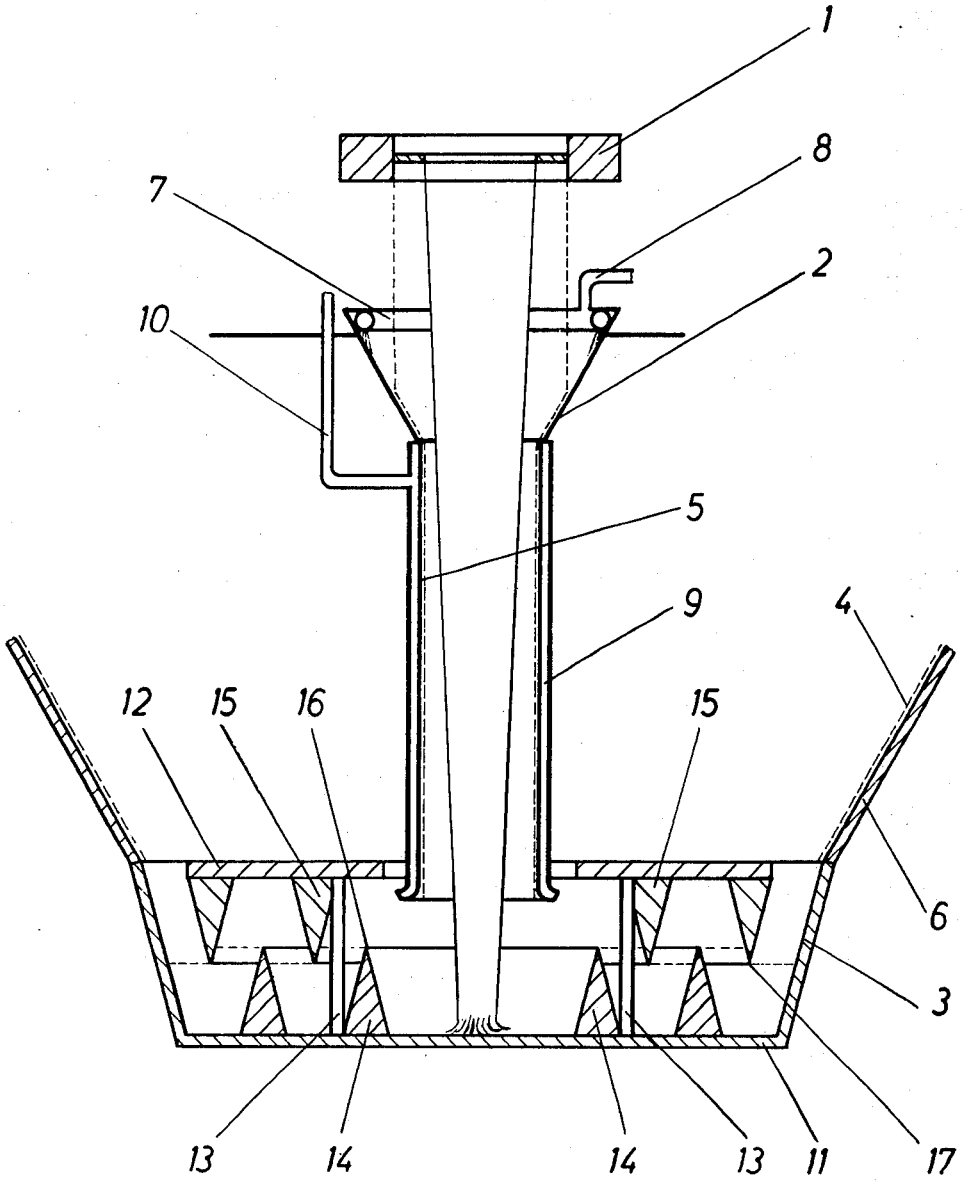

FIG. 2
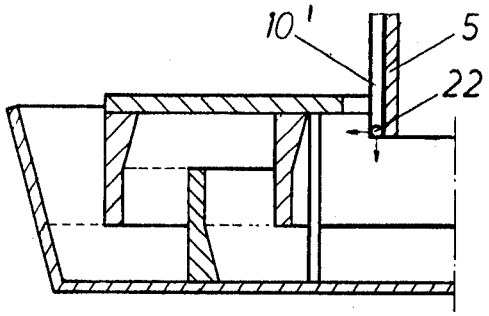
FIG. 2a
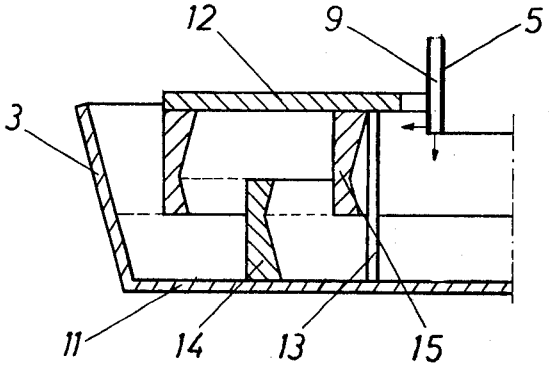
FIG. 2b
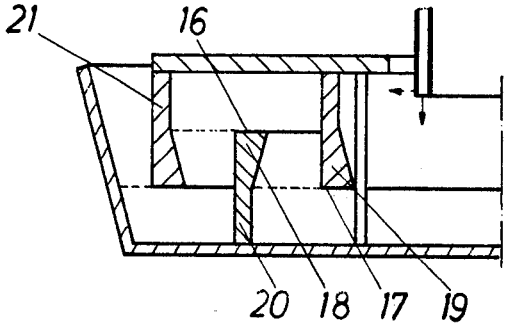
FIG. 2c
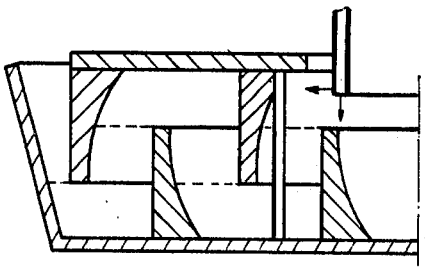
FIG. 2d

FIG. 3
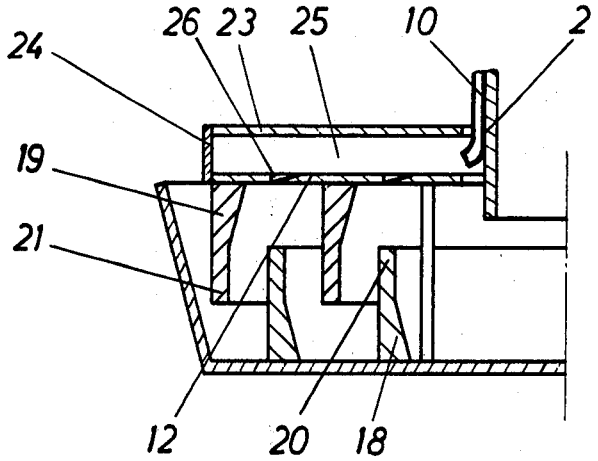
FIG. 3a
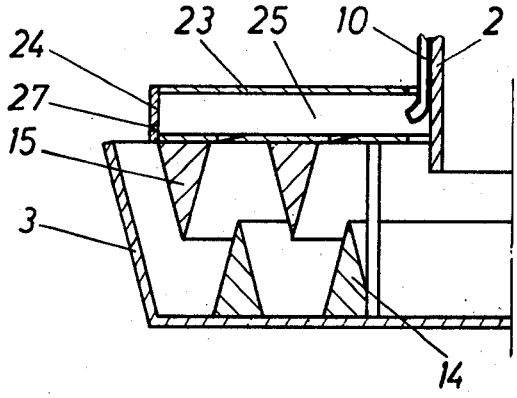
FIG. 3b
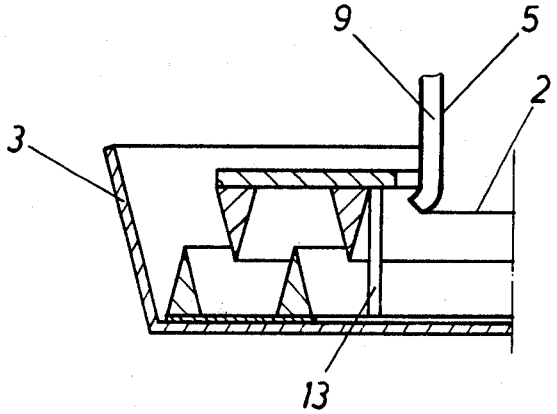
FIG. 3c

FIG. 5
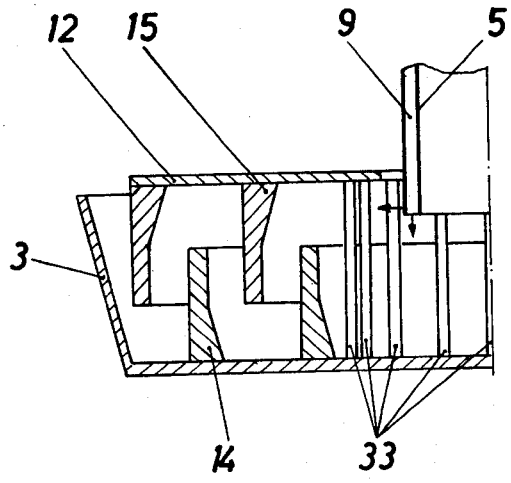
FIG. 5a
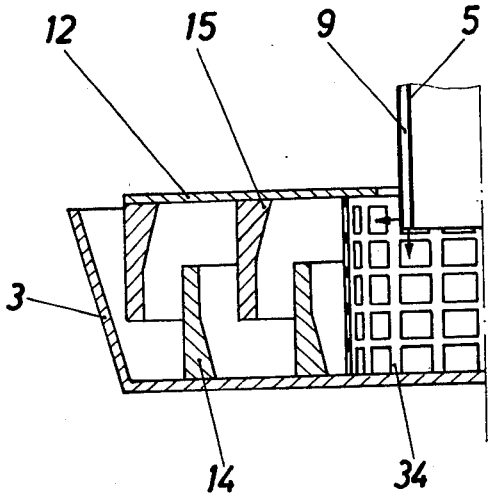
FIG. 5b

CENTRIFUGE

This invention pertains to a centrifuge, particularly a sugar centrifuge for continuously centrifuging highly viscous fillmasses, for example, after product fillmasses.

As is known, the required condition for the best operation of continuous centrifuging is a uniform distribution of the fillmass over the entire sieve surface. Furthermore, the cooling of the fillmass within the centrifuge must be prevented. During continuous centrifuging of high viscous sugar fillmasses, particularly after product fillmasses, it is also necessary to diminish the viscosity within the centrifuge in such manner that a uniform distribution of very ductile strand-like fillmass brought into the centrifuge is possible upon the sieve surface. It is also necessary to provide means for the acceleration of the centrifugal mass in such manner that there is a comparatively easy transmission from the accelerating device to the separating sieve to avoid to a great extent the destruction of crystals. Finally a continuous centrifuge must be so constructed that in case of disturbances (for example, breakdown of the drive, clogging of the accelerating pot and the like) the supply of the fillmass is automatically interrupted until the disturbance is eliminated.

Many different procedures have been suggested to take care of these requirements. German specification 1,856,491 describes a continuously operating sieve centrifuge, particularly for viscous sugar fillmasses provided with a conical sieve drum expanding to the discharge end and receiving the mixture to be separated through an acceleration pot located at the lower end of the sieve drum in its rotational center and rotating in the same direction. The wall of the pot which is devoid of holes has a smaller conicity relatively to the drum axis than the sieve drum. To diminish the structural height of the drum while retaining a good acceleration action of the acceleration pot and to provide at the same time a good distribution of the fillmass upon the separating sieve the acceleration pot is provided with inner surfaces which increase the sliding resistance of the separating mixture moving over it. These inner surfaces can be totally or partly roughened, curved, ribbed, channeled or punched, whereby these curves, ribs or the like preferably extend concentrically to the axis of the drum.

This known construction makes it possible while diminishing the height of the drum to provide a uniform distribution of normal viscous fillmasses upon the separating sieve. However, this device is inoperative by itself for centrifuging highly viscous after product fillmass due to the great viscosity of the fillmass. It is actually necessary to heat within the centrifuge the after product fillmass which was cooled to about 40° to 50° C. For this purpose the German specification 1,019,251 provides for a slide centrifuge so that the fillmass should be heated by a tube opening in the interior of the inlet funnel of the centrifuge into the centrifuging space, whereby steam or hot air serve as heating means. This known device is not satisfactory, however, since hot air or steam heat only the outer surface of the fillmass layer which forms a very thick layer upon the separating sieve. The heat can not penetrate through the compact strong layer.

For that reason the German specification 1,159,859 suggests a sugar centrifuge with a substantially conical sieve hurler enclosed by a space for molasses and provided with devices introducing heat carriers into the molasses space. These devices cooperate with a known self-actuating regulating device which keeps constant the temperature in the molasses space. The devices introducing heat carriers open in the range of the smallest circumference of the sieve hurling drum into the molasses space or the supply tube for the heat carriers extends close to the floor of the molasses space and close to the drum bearing. Heat carriers are steam, hot air or also cold air. This known construction has the drawback that it is not possible to avoid a heating of the centrifugal drum bearing.

To avoid this detrimental effect German specification 1,278,952 provides a centrifuge for the continuous separation of solid and liquid mixtures, particularly a sugar centrifuge having a conical casting drum widening from the bottom toward the top and rotating about a vertical axis. The centrifuge also has an accelerating pot forming the bottom of the drum, a drum frame fixed thereon with a sieve cover lying upon its inner side and a covering spaced from it and enclosing it. This covering along with the sieve cover form a conical ring space open on the top for the centrifuged liquid passing through the sieve cover. The ring space of the casting drum enclosing the sieve cover can be supplied with heating means, preferably steam through openings provided in its lower part.

This construction improves the flow of molasses and prevents the cooling of the fillmass upon the separating sieve. However, with this device it is not possible to lower the viscosity of the fillmass to a sufficient extent. However, German specification 1,265,666 describes a continuously operating sugar centrifuge with a conic thrust drum and an accelerating device located within the drum and rotating therewith for the high viscous fillmass to be transmitted to the conical sieve. In this construction a device is provided for heating the fillmass by a heat carrier, whereby the supply of the heat carrier is arranged within the accelerating device and molasses are used as the heat carrier.

Furthermore, German specification 1,567,286 describes a process for covering the fillmass located upon the sieve of a casting drum by thrust molasses, whereby a molasses flow is separated during or immediately after the centrifuging. After its heating it is returned into the centrifuge and is used there as the covering molasses, whereby the covering molasses when necessary are heated and thinned by injection of steam.

These known measures do not provide the desired success since due to the different weights of the filling mass and the heated molasses the centrifugal force causes the fillmass to provide a compact layer upon the wall of the accelerating device or the separating sieve, upon which slide the warmer and lighter molasses. Therefore molasses can penetrate into and heat the fillmass only to a small extent and they can not mix sufficiently intensively with the fillmass. This is particularly true of the construction described in German specification 1,265,666, since there during transmission from the accelerating device to the separating sieve the heated molasses initially reach the separating sieve and are thrust out already in the lower separating sieve range.

To avoid these drawbacks German specification 1,265,665 suggests that the inflow of the diluting liquid (clear syrup) should take place coaxially within the centrifuged mass entering centrally the acceleration pot of the centrifuging drum. The specification includes in rough translation the following statement: "During the strike upon the bottom of the centrifuging drum a layer of diluting liquid is produced as the lowermost layer, since the diluting liquid lies coaxially within the beam of the precipitated goods, although the diluting liquid is normally lighter than the precipitated goods. The result is that the thickly liquid precipitated goods do not come directly with the bottom of the accelerating pot of the centrifuging drum, but can slide lightly upon the diluting liquid. When the drum wall is reached upon which both liquids rise upwardly, the specifically heavier precipitated goods press outwardly and penetrate through the diluting liquid. In this manner upon a very short stretch a very thorough mixing of the precipitated goods with the diluting liquid is attained, so that solid bodies contained in the precipitated goods are substantially not diluted by the diluting liquid; however, a substantial diminution of the viscosity of the precipitated goods is attained so that it can extend itself sufficiently well."

The above stated teaching of the German specification 1,265,665 can perhaps have validity for the continuous centrifuging of fillmasses of small viscosity. It is actually dangerous when transmitted to the continuous centrifuging of highly viscose after product fillmasses, as will be apparent from the following:

Continuous centrifuges are operated in the sugar industry with about 2,000 r.p.m., whereby the clear syrup introduced coaxially into the accelerating pot forms a closed sliding film upon the bottom and the walls of the accelerated pot which is struck by the non rotating, very stiff and tough after product fillmass strand. Here it is necessary to accelerate the after product fillmass strand blowlike from 0 to 2,000 r.p.m. As the result a more or less lengthy strand portion is torn away from the slowly following after product fillmass strand, which due to the sliding effect of the clear syrup in fractions of a second is guided to the wall of the accelerating pot, moved away from it and then is thrown out of the centrifuge without substantial deformation. This not only endangers the centrifuge but there is also a substantial danger of accidents due to the flying fillmass. Furthermore, there is no separation of the fillmass into hard and liquid component parts (the above described conditions are also apparent from the German specification 2,008,182).

A further drawback of the teachings of the German specification 1,265,665 is based in that the used clear syrup has a substantially higher amount of sugar that must be present in the removed molasses. This amount of sugar is lost in the device operating according to this teaching and the sugar output is diminished.

Finally in the publication "The Australian Sugar Journal," issue No. 12 of Mar., 1972 and "Sugar Z. Zuckerind.," 23 (1973) No. 4 as well as the German specification 7,207,102 is described a procedure by the use of which during continuous centrifuging of after product fillmasses of high viscosity an output increase of 100% is achieved. This procedure has the purpose of improving flow properties of the after product fillmass which is produced by a thorough mixture of the three components fillmass, water and steam. The result should show a better distribution of the fillmass upon the separating sieve. A pamphlet entitled "Substantial output increase by a new fillmass supplying device" makes, among others, the following statements about these procedures (rough translation):

"In the sugar industry particularly after product fillmasses are cooked in increasing measure with high crystal content. While this produces a higher crystal output the increasing viscosity also places greater demands upon the operation of the centrifuges. The requirement for the best operation of the continuous centrifuge is that the tough fillmass should also be uniformly distributed over the entire sieve surface . . . During the past years the supply of the fillmass, the device for accelerating and dividing the fillmass as well as the operation of the hurling basket were successfully improved. Also the greatly different examinations in connection with the supply of water and steam have lead to higher sugar qualities. Finally it should be noted that it was also possible to solve the problems of temperature supply and air whirling within the centrifuge . . .

A further decisive result of the systematic development work is the new fillmass supplying device for treating after profile fillmasses. The device consists of two structural parts, namely, the inlet pipe serves to supply the fillmass ray emerging from the screen regulating slide into the accelerating unit of the continuous centrifuge as well as for sprinkling the fillmass ray with water and steam. The supply of water takes place by an annular conduit located upon the funnel shaped inlet, the conduit being provided for this purpose with fine bores upon the inner side of the ring and a water connection. Steam is introduced into the annular space closed at the front of a double walled tube and reaches through bores of the inner tube the fillmass ray which is already sprayed with water The inside diameter of the inlet pipe is made so that fillmass ray flowing into the centrifuge normally does not touch the tube. However there is the possibility of touching when the fillmass ray is, for example, deviated by outside influences. In that case now used inflow devices would most likely run over when treating tough fillmasses. These disturbances do not take place in the described inflow of the fillmass. An inlet pipe supplied with steam causes a quick outflow of the fillmass ray contacting the tube due to viscosity drop. The lubricating effect of the water sprayed upon the fillmass ray supports this procedure.

By spraying the fillmass ray with water and steam in the inlet pipe there is thus always provided a continuous inflow of the desired fillmass amount into the centrifuge. At the same time the "lock" of water and steam located between the fillmass ray and the wall of the inlet pipe, prevents the sucking of cold surrounding air with the fillmass ray into the interior of the centrifuge which would have a negative effect upon the centrifuging process.

The distributing device consists of a cylindrical distributing pot with several vertical distributing pins and an accelerating socket which is screwed by vertical rods with the distributing pot. Since the lower edge of the inlet pipe is located below the top ends of the distributing pins, the three components, fillmass, water and steam flowing out of the inlet pipe into the distributing pot are engaged by the distributing pins and are thoroughly intermixed. In this manner it is possible to increase to the best possible extent the flexibility and the flow properties of the fillmass with a minimum of water and steam.

Fillmass thus prepared is divided by the distributing device to a better and more uniform extent and is thrust more effectively into the centrifuging box. Since due to the short action of water and steam upon the fillmass after the mixing only a diminution of viscosity of the fillmass takes place, the continuous centrifuge provided with the new fillmass supplying device produces sugar of higher quality with substantially the same molasses quality."

This above described known device is not satisfactory, however, in its operation since it has some drawbacks and dangers which can not be overlooked. It is known that the highly viscose after product fillmass flows extremely slowly in a tough and rigid strand into the centrifuge while passing the supply tube and being sprayed there with water and steam, whereby steam is condensed at the cooled outer layer of the fillmass strand. The fillmass strand reaches with this coating of water and condensed steam the centrifuging pot and is moved upon its bottom in the direction of the cylindrical pot walls. It is moved to the dividing pins which rotate with the pot, is divided by them into small strand parts and is guided over the pot walls upon the inner wall of the accelerating socket. The individual fillmass part strand can divide itself only upon the inner wall of the accelerating socket and upon its way to the smallest diameter of the conically widening separating sieve be mixed with water and condensed steam.

Due to the comparatively long time extending from the inflow of the fillmass into the delivery pipe and the transmission of the fillmass from the accelerating socket to the separating sieve, there is the danger that sugar will be dissolved by water and condensed steam.

Furthermore, with this centrifuge it can easily happen that larger fillmass lumps, dirt or the like do not pass through the comparatively small gap of the transmission between the accelerating pot and the accelerating socket, thus closing the gap and thereby causing the overflow of the centrifuge, since the supply of the fillmass is not automatically stopped. This is also the case when due to the stopping of the drive the centrifugal drum comes to stand still.

Therefore, an object of the present invention is to so construct a centrifuge, particularly a sugar centrifuge for continuously centrifuging high viscous fillmasses, for example, after product fillmasses, that the above described drawbacks will not take place and on the contrary the high viscous fillmass will be carefully accelerated with the greatest protection of sugar crystals while simultaneously diminishing the viscosity to the desired extent during the shortest possible time and wherein in case of disturbances the flow of the fillmass is stopped until disturbances are eliminated, so that an over flow of the centrifuge is avoided.

In the solution of the objectives of the present invention a continuous centrifuge is used having a separating sieve conically widening upwardly to the outlet and an accelerating pot having no holes which reduces downwardly and is connected to the smallest diameter of the sieve. The objectives of the present invention are realized in that the fillmass within the accelerating pot is deviated once or several times in such manner that it is lead screen-like to the wall of the pot and is guided from one deviating point to another, and within its screen-like formation is penetrated by regulatable amounts of water and/or steam to sufficiently diminish its viscosity. The inner space of the centrifugal drum is continuously controlled relatively to the height of the fillmass level upon the bottom of the centrifugal drum or the flow pipe by a device connected with the centrifuge and consisting of a tube conduit, a container with liquid shaped as communicating tubes and a float switch.

The invention will appear more clearly from the following detailed description when taken in connection with the accompanying drawings showing by way of example only, preferred embodiments of the inventive idea.

In the drawings:

FIG. 1 is a section through a centrifuge of the present invention.

Figure 1B:
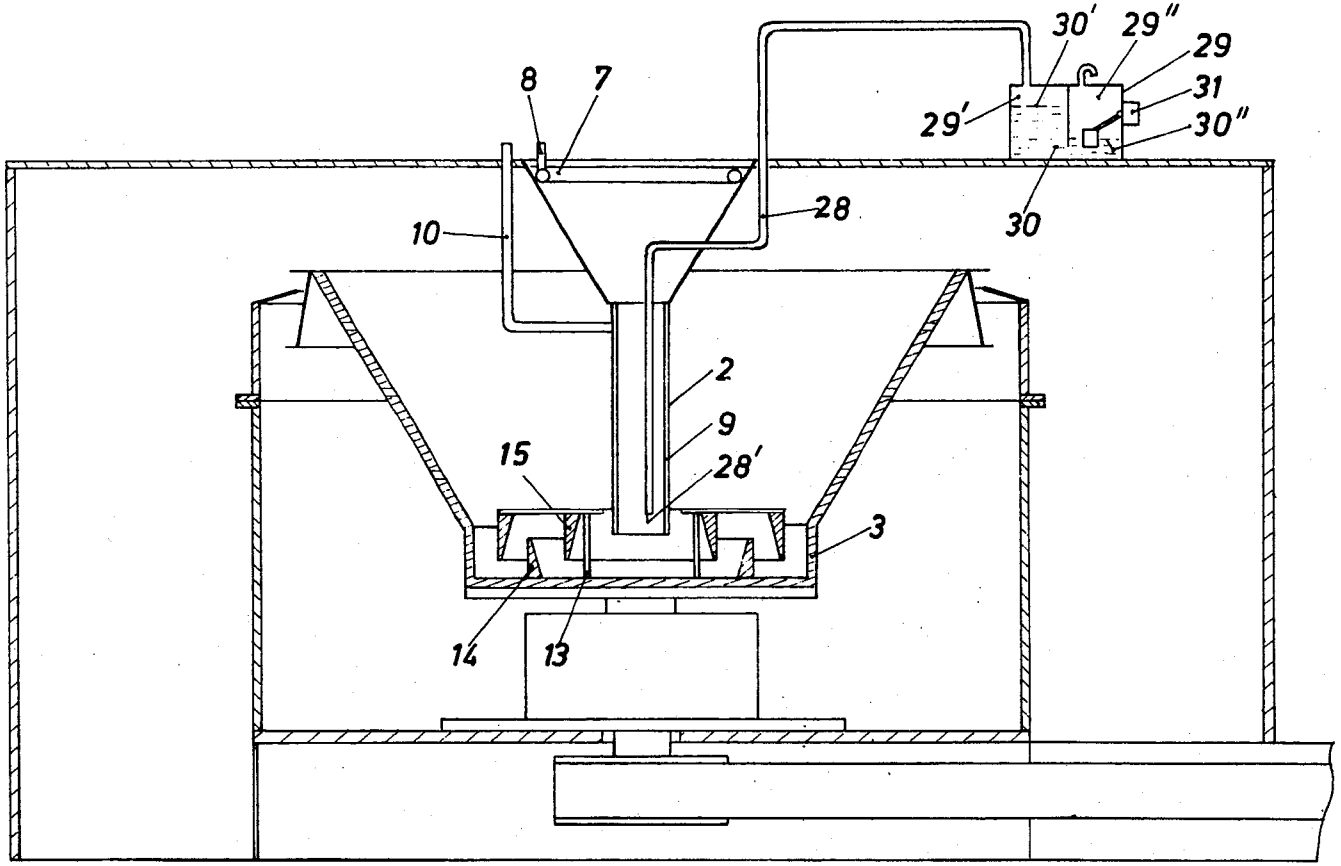

FIG. 1*b* is a further sectional illustration of the centrifuge of FIG. 1 with various parts connected therewith.

FIGS. 2*a*, 2*b*, 2*c* and 2*d* show various shapes of concentric rings.

FIGS. 3*a*, 3*b* and 3*c* show various shapes of accelerating parts.

Figure 4:
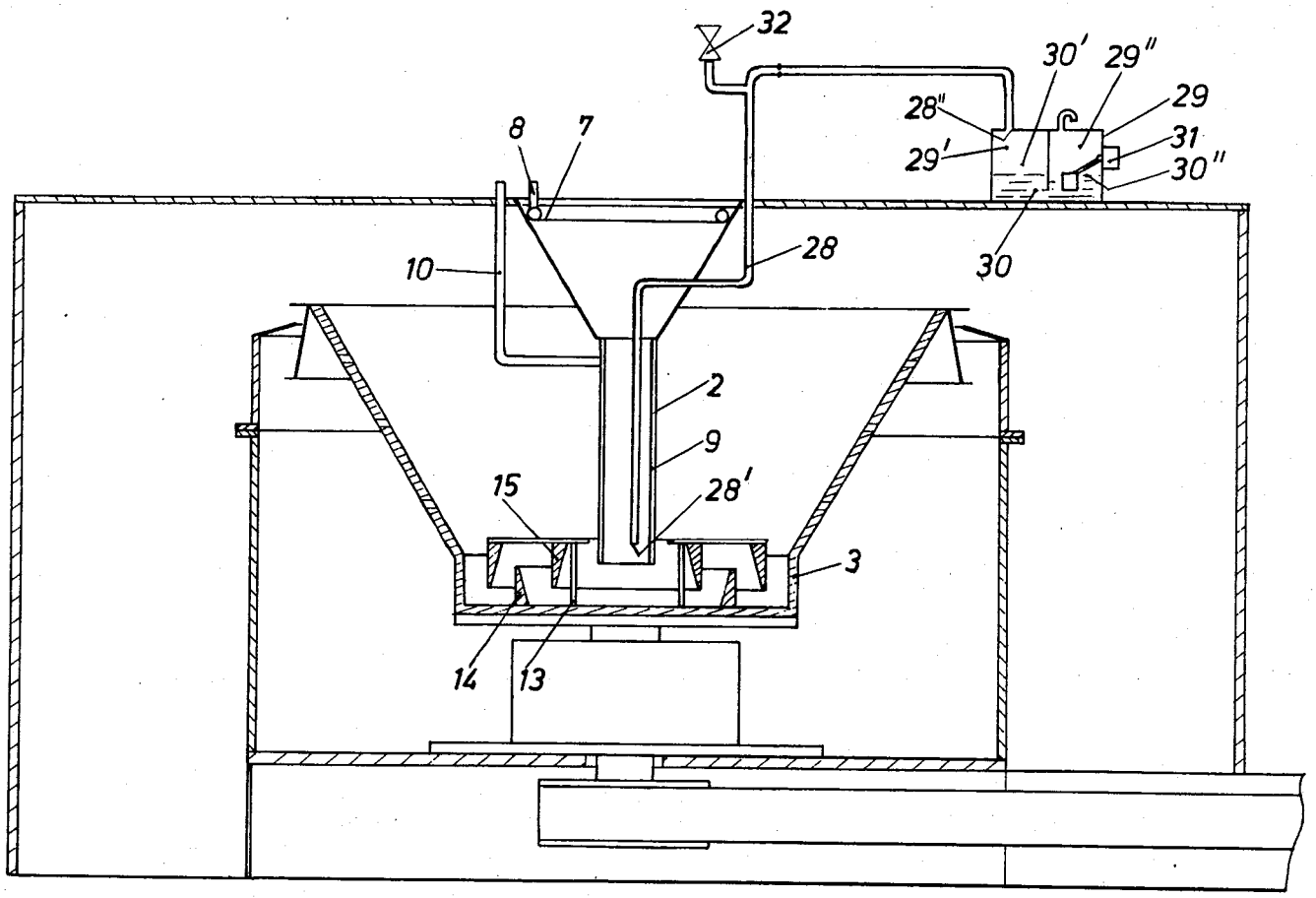

FIG. 4 is a section through a differently constructed centrifuge of the present invention.

FIGS. 5*a* and 5*b* show different constructions of the accelerating pot.

FIG. 1 shows that the high viscose fillmass passes through the so-called Egger slide 1 and the supply tube 2 to the accelerating pot 3 and there through one or several diverting means comes to the separating sieve 4. To make certain that the fillmass during its diversion will not be stuck upon the inner wall 5 of the tube 2, water leaving the slide 1 is used to spray the inner wall of the tube and to form a slide film. In case that this amount of water will not be sufficient to form a slide film, an annularly shaped water pipe 7 is provided upon the upper end of the tube 2 and is connected with water supply 8; it has downwardly directed outlet openings.

The tube 2 is double walled in the known manner under the cover of the casing. A pipe 10 leads into space 9 which is thus formed and supplies steam or another suitable gas into the space 9 which leaves this space through the outwardly bent end of the tube 2 by passing into the accelerating pot 3. A concentric plate 12 covers the bottom 11 of the pot with variable spacing; it is connected with the pot by distancing rods 13 and rotates with the pot.

The bottom 11 of the accelerating pot 3 is provided with one or several rings 14 which correspond to one or several rings 15 connected with the plate 12. These rings 14, 15 provide a single or multiple diversion of the fillmass in that the diverting point 16 of a lower ring 14 is located above the diverting point 17 of an upper ring 15. Thus the fillmass is guided as a screen on the wall of the pot 3 and from one diverting point 16 to another diverting point 17 and thus is accelerated in a preserving manner to the circumferential speed of the walls of the accelerating pot so that destruction of sugar crystals is avoided.

Since the steam penetrates only within the acceleration pot into the spaces formed by rings 14, 15 it can easily penetrate the screen-like structure of the fillmass and heat it. At the same time an intensive mixing takes place of the fillmass with water downwardly emerging from the supply pipe. Since the fillmass is in contact with water and/or steam only for a short time, a dissolution of sugar is avoided, while a diminution of viscosity to the desired amount is securely provided. For that purpose water as well as steam (or a suitable liquid, such as hot molasses, syrup or the like, and/or gas) can be regulated as far as their amount and temperature are concerned. The amount of water and/or steam supplied to the fillmass in the acceleration pot is composed of the amount of water leaving the slide 1 as well as amounts of water and/or steam supplied by the pipes 7 and 10.

The rings 14, 15 can be replaced individually or totally by rings of other shapes, so that an adaptation to the viscosity of the fillmass is easily possible.

A device is added to the centrifuge to make certain that the centrifuge will not overrun in case of disturbances. This device (FIG. 1*b*) comprises a conducting pipe 28, a container 29 having the shape of communicating tubes and filled with liquid 30 and a floating switch 31. This device continuously regulates the interior of the centrifuge drum 6 in relation to the height of the fillmass level formed in the acceleration pot 3 or the supply tube 2. It interrupts the flow of the fillmass when the level of the fillmass exceeds a certain measure due to appearing disturbances, such as interruption of the drive through errors in mechanical power transmission, or clogging of the centrifugal drum through the formation of clumps or dirt in the fillmass or the like. The present invention makes use of the fact that in the centrifuge drum there is an under pressure of a few cmWS while in the molasses chamber 32 (FIG. 4) there is over pressure of a few cmWS. Under pressure prevailing in the centrifuge drum 6 exerts suction upon the tube 28 which with its end 28' extends into the acceleration pot 3 or lies shortly above the end of the double tube 2 and within the tube. The pipe 28 is connected with its other end 28'' with a container 29 shaped as communicating tubes and consisting of chambers 29' and 29'' which are interconnected and contain a liquid. The chamber 29'' is provided with a floating switch 31 which is either directly operatively connected with a driving mechanism of a slide provided in the fillmass flow or which actuates an alarming device.

As long as there are no disturbances the liquid level 30' in the chamber 29' is higher than the liquid level 30'' in the chamber 29'' and the floating switch has no action. If the drive is interrupted by an error in mechanical force transmission or if the centrifuge drum is clogged by clump formation or dirt in the fillmass, then the level of the fillmass rises and the rising fillmass closes the end 28' of the pipe 28. Then the suction effect upon the pipe 28 is interrupted. The liquid level 30' is lowered while the liquid level 30'' is simultaneously raised, with the result that the floating switch 31 acts by its contact upon the driving mechanism of the slide located in the fillmass flow which actuates the slide and stops the flow of the fillmass. However, the floating switch 31 can also release an alarming device producing an alarm signal causing a servicer to close the slide.

In this embodiment of the present invention the pressure key for switching the driving motor on and off is preferably provided with a second contact which when actuated bridges the contact of the float switch in such manner that the centrifuge can be operated without the supply of the fillmass until under-pressure acting upon the pipe 28 is again produced in the centrifuge drum, with the result that the liquid level 30' rises to the required extent while simultaneously the liquid level 30'' in the chamber 29'' is lowered and the float switch 31 drops off from its contacts. The switch opens and the fillmass is again supplied to the centrifuge.

FIGS. 2*a* to 2*d* show a few possible shapes of rings whereby these rings 14, 15 preferably have a positive and/or negative conicity to the axis of the accelerating pot 3. The ring portions 18, 19 having positive or negative conicity can go over into cylindrical ring portions 20, 21. The steam or the suitable gas can be transmitted to the accelerating pot 3 through the line 10 and the space 9 provided in the double cover tube 2, or through a line 10' extending into the accelerating pot, which if necessary opens into a ring-shaped conduit 22 with nozzles surrounding the supply tube. However, steam can also flow out radially and if necessary vertically. There is also the possibility of providing the steam pipe 10 within the delivery tube 2.

FIGS. 3*a* to 3*c* show constructions wherein the plate 12 jointly with a spaced and covering disc 23 and an annular strap sheet 24 form an annular chamber 25 into which steam or water is introduced. The plate 12 has nozzle shaped openings 26. In addition the strap sheet 24 can be provided with nozzle shaped openings 27 distributed over its circumference.

According to a further development of the present invention the supply tube 2 extents at its upper end up to the slide 1 and is airtightly connected therewith. This construction prevents the suction of cooler outside air into the interior of the centrifuge. A further advantage of this arrangement is that the temperature without additional heat supply is raised by steam, gases, etc. in the centrifuge by a few degrees (about 60 C), so that a diminution of viscosity in the fillmass takes place already, so that it is possible to diminish the amounts of liquid and/or gaseous media supplied to the fillmass for desired lowering of viscosity.

FIG. 4 shows another embodiment of the centrifuge and its supervising device. Sometimes the suction produced upon the pipe 28 in a continuous centrifuge is not sufficient to hold properly the float switch. In order to be able to use the supervising device of the present invention in such centrifuges, a further embodiment of the present invention provides the supply of air, eventually heated air to the tube 28 through the valve 32. If the level of the fillmass rises and closes the lower end 28' of the tube 28, increasing pressure will be exerted upon the liquid level 30' which causes the level size of the liquid level 30'' and thus the switching of the float switch, with the result that the slide located in the inflow of the fillmass will interrupt this flow.

The supervising device of the present invention in addition to its use in continuous sugar centrifuges is also most suitable for the supervision of such centrifuges which are located in rooms subject to explosion dangers. This is based in that the container 29 with its voltage guiding float switch can be located outside of the dangerous room. It is also obvious that continuous centrifuges of all other types can be provided with the supervising device of the present invention.

FIGS. 5*a* and 5*b* show other embodiments of the invention. FIG. 5*a* shows that the rods 13 can be replaced by a box 33 consisting of a plurality of rods to provide a more uniform distribution of the fillmass. According to FIG. 5*b* it is possible within the framework of the present invention to replace the rod box 33 with a perforated sheet box 34.

What is claimed is:

1. A sugar centrifuge for viscous fillmasses, comprising a conical sieve basket rotatable about a vertical axis and having an upwardly directed outlet, an unperforated accelerating cup connected to said sieve basket at the smallest diameter thereof, said accelerating cup comprising at least one lower deflecting ring fastened coaxially on the bottom of said accelerating cup, a plate concentrically covering the bottom of said accelerating cup, a coaxial upper deflecting ring fastened to said plate, distancing rods connected to said plate to provide variable spacing, a box rotatable along with said cup, a coaxially double walled feed pipe having a lower open end communicating with the space between the upper and lower deflecting rings, a gas conducting pipe extending into the space between the two walls of the double walled feed pipe, another conducting pipe extending into the interior of said double walled feed pipe, a container having the shape of communicating tubes and connected with said other conducting pipe, said container being adapted to be filled with a liquid, a float switch in said container and means connected with said pipes for regulating the amount and temperature of water and steam supplied thereto.

2. A sugar centrifuge according to claim 1, comprising an alarm device connected with said float switch.

3. A sugar centrifuge according to claim 1, wherein said rings are exchangable and wherein said distancing rods are also connected with said cup, whereby said cup is rotatable along with said plate.

4. A sugar centrifuge according to calim 1, wherein the lower end of said other conducting pipe is located above the lower end of said double walled feed pipe.

5. A sugar centrifuge according to claim 1, comprising a water supplying feed valve airtightly connected with the top of said feed pipe.

6. A centrifuge according to claim 1, wherein the water supplying means comprise pipes with nozzles transmitting water directly to the fillmass in said cup, said plate also having nozzle-shaped openings.

7. A centrifuge according to claim 6, wherein said rings have conical portions relative to the axis of said cup.

8. A centrifuge according to claim 7, wherein said rings have substantially cylindrical portions constituting a continuation of said conical portions.

9. A centrifuge according to claim 8, comprising a disc spaced from and covering said plate and an annular strap sheet extending between said disc and said plate, whereby a water-receiving annular chamber is formed.

10. A centrifuge according to claim 9, wherein said strap sheet has nozzle-like openings spaced over its circumference.

11. A sugar centrifuge according to claim 1, comprising a water-carrying ring pipe located adjacent the upper end of said double walled feed pipe, means supplying water to said ring pipe, and nozzles carried by said ring pipe and directed toward the inner wall of said double walled feed pipe.

12. A centrifuge according to claim 11, wherein said means supplying a treating medium supply other liquids and gases besides water and steam.

13. A centrifuge according to claim 12, wherein during normal operation suction is exerted upon said tube which maintains a level in said container with communicating spaces eliminating action by said float switch.

14. A centrifuge according to claim 13, wherein during operational disturbances the fillmass level closes said tube and is varied in said container with communicating spaces to actuate said float switch, said centrifuge having means actuated by said float switch to stop its operation.

15. A centrifuge according to claim 14, wherein said container with communicating spaces has a chamber communicating with the end of said tube and a chamber communicating with said float switch, whereby during operational disturbances the fillmass closes the end of the tube and has levels in the chambers of said containers causing an actuation of said float switch.

16. A centrifuge according to claim 15, wherein said deviating means comprise a box carrying deviations selected from the group consisting of rods, perforated sheets and slitted sheets.

* * * * *